United States Patent [19]

Winterer

[11] Patent Number: 4,502,297

[45] Date of Patent: Mar. 5, 1985

[54] EVAPORATOR PARTICULARLY SUITABLE FOR AIR CONDITIONERS IN AUTOMOTIVE VEHICLES

[75] Inventor: Wilfried Winterer, Leinfelden-Echterdingen, Fed. Rep. of Germany

[73] Assignee: Sueddeutsche Kuehlerfabrik Julius Fr. Behr GmbH & Co., KG, Stuttgart, Fed. Rep. of Germany

[21] Appl. No.: 554,306

[22] Filed: Nov. 22, 1983

Related U.S. Application Data

[62] Division of Ser. No. 394,876, Jul. 2, 1982, Pat. No. 4,430,868.

[30] Foreign Application Priority Data

Dec. 18, 1981 [DE] Fed. Rep. of Germany ..... 31501

[51] Int. Cl.[3] ..... F25B 39/02

[52] U.S. Cl. ..... 62/515; 165/168

[58] Field of Search ..... 62/514 R, 515; 165/168

[56] References Cited

U.S. PATENT DOCUMENTS

| | | | |
|---|---|---|---|
| 2,803,116 | 8/1957 | Tilney | 62/525 |
| 3,563,055 | 2/1971 | Owens | 62/504 |
| 3,858,406 | 1/1975 | Izumi . | |
| 4,244,194 | 1/1981 | Haester et al. | 62/515 |
| 4,386,505 | 6/1983 | Little | 62/514 R |
| 4,430,868 | 2/1984 | Kern et al. | 62/515 |

FOREIGN PATENT DOCUMENTS

| | | |
|---|---|---|
| 2847525 | 5/1980 | Fed. Rep. of Germany . |
| 1444609 | 8/1976 | United Kingdom . |

*Primary Examiner*—Ronald C. Capossela

*Attorney, Agent, or Firm*—Schwartz, Jeffery, Schwaab, Mack, Blumenthal & Koch

[57] ABSTRACT

Disclosed is an evaporator comprising a connector member comprising at least two plates located one above the other, a Venturi distributor connected to the connector member for receiving and distributing a coolant, wherein the Venturi distributor divides the coolant into a plurality of streams, a plurality of channels arranged as grooves on the surface of one of said two plates and covered by the other of said two plates for conducting the coolant streams from the Venturi distributor, the channels corresponding in number to the streams with each channel being positioned to receive one of the streams from the Venturi distributor, a plurality of evaporator pipes connected to the connector member in parallel flow arrangement, the pipes corresponding in number to the channels with each pipe being connected to one of the channels, thereby forming a continuous coolant flow path from the Venturi distributor via the channels to the evaporator pipes, and a collection chamber formed in the connector member for receiving the coolant from the pipes. Also disclosed is the use of the evaporator in air conditioners, particularly those of automotive vehicles.

14 Claims, 4 Drawing Figures

EVAPORATOR PARTICULARLY SUITABLE FOR AIR CONDITIONERS IN AUTOMOTIVE VEHICLES

This is a division of application Ser. No. 394,876, filed July 2, 1982 now U.S. Pat. No. 4,430,868.

BACKGROUND OF THE INVENTION

The present invention relates to an evaporator, in particular for air conditioners in automotive vehicles.

An evaporator for air conditioners is described in DE-OS No. 28 47 525. The evaporator comprises an evaporator block containing a plurality of bifurcated pipes and cooler baffles, and a connector box or tank. A distributor chamber and a collector chamber are integrated in the connector box. The coolant is introduced by means of a coolant injector into the distributor chamber, flows through the U-shaped bifurcated pipes and is drawn off, after entering the collector chamber, through a compressor suction line.

In an evaporator of this type, all of the evaporator pipes consist of bifurcated pipes, each of which extends into the distributor chamber and into the collector chamber. All bifurcated pipes thus form evaporator pipes installed in parallel. In such a configuration, a uniform distribution of the coolant present in two phases with equal phase proportions in all of the parallel evaporator pipes is only adequately possible when the number of parallel evaporator pipes is very low. In view of capacity values customary in automotive vehicles, this means that the evaporator must be very slender and have very long bifurcated pipes. The structural space required for such a design is usually not available. Because the plurality of evaporator pipes are supplied by a common injector and distributor chamber, the cooling effect over the block volume is not uniform, since the flow of the coolant is distributed non-uniformly. This non-uniformity leads to a reduction in the performance of the evaporator.

A coolant flow distributor derived from the Venturi tube is described in U.S. Pat. No. 2,803,116. This distributor consists at its inlet side of a Venturi tube and at its outlet side of a plurality of outlet channels, having individual diameters smaller than the narrowest cross section of the Venturi tube. The outlet channels are arranged symmetrically on a conical surface. They form in the center of the Venturi tube a conical point. In known evaporators, distributor pipes are soldered into the outlet channels of the Venturi distributor and these are connected with the evaporator pipes, with the number of outlet channels corresponding to the number of evaporator pipes, consisting of several bifurcated pipes connected in series. In order to obtain the same flow resistance in all of the inlet pipes, they must be individually bent and aligned, resulting in high costs. The soldering of the bifurcated pipes and the functional testing required by it, are also cost intensive processes.

SUMMARY OF THE INVENTION

It is therefore an object of the present invention to provide an improved evaporator, particularly for use in automotive air conditioners.

Another object of the invention resides in providing such an evaporator which is simple in its configuration and economical to manufacture, and whereby a cooling effect uniformly distributed over the evaporator block can be obtained.

In accomplishing the foregoing objectives, there has been provided in accordance with the present invention an evaporator comprising a connector member or box comprising at least two plates located one above the other, a Venturi distributor connected to the connector member for receiving and distributing a coolant, wherein the Venturi distributor divides the coolant into a plurality of streams, a plurality of channels arranged as grooves on the surface of one of said two plates and covered by the other of said two plates member for conducting the coolant streams from the Venturi distributor wherein the number of channels corresponds to the number of streams, with each channel being positioned to receive one of the streams from the Venturi distributor, a plurality of evaporator pipes connected to the connector member in parallel flow arrangement, these pipes corresponding in number to the channels with each pipe being connected to one of the channels, thereby forming a continuous coolant flow path from the Venturi distributor via the channels to the evaporator pipes, and a collection chamber formed in the connector member for receiving the coolant from the pipes.

Further objects, features and advantages of the present invention will become apparent from the detailed description of preferred embodiments which follows, when considered together with the attached figures of drawing.

DETAILED DESCRIPTION OF PREFERRED EMBODIMENTS

Figure 1:
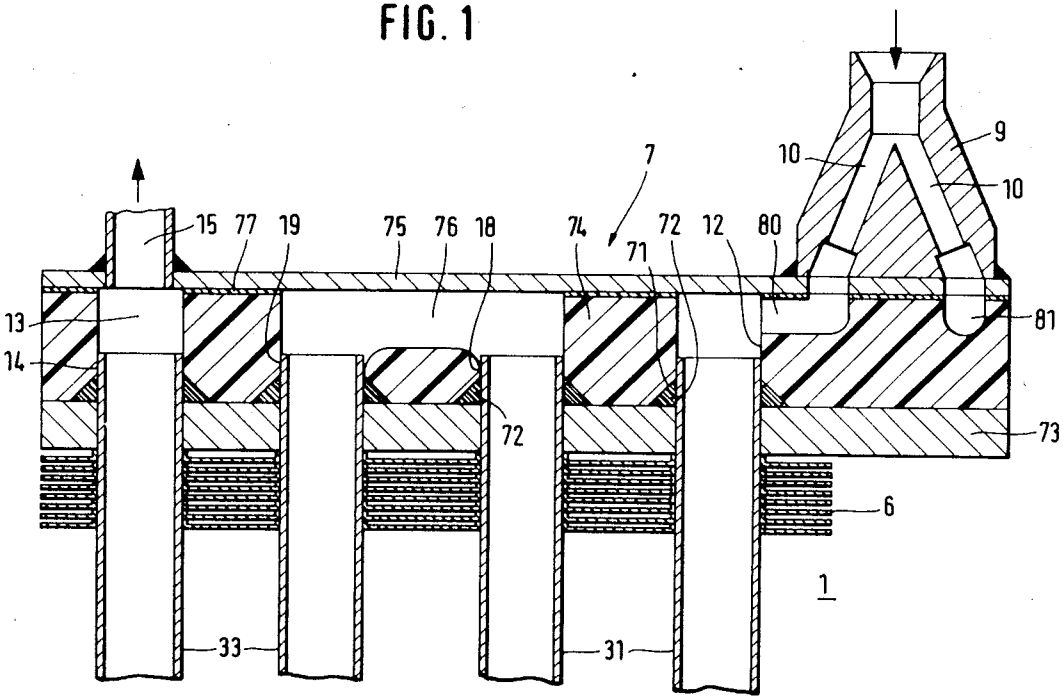
FIG. 1 is a cross-sectional view through a connector box of an evaporator.

An advantage of the evaporator according to the invention may be found in that the coolant streams, once distributed uniformly, are maintained over the entire length of the pipe, thereby assuring uniform evaporation in all of the pipes, resulting in a high degree of utilization and making possible the optimum dimensioning of the evaporator.

According to a preferred further development of the invention, the Venturi distributor has a number of outlet channels, arranged circularly and corresponding to the number of parallel evaporator pipes. The outlet channels are connected through the conduits with the individual evaporator pipes. In order to assure that the outlet channels of the Venturi distributor always coincide with the channels and to prevent rotation thereof with respect to the channels, the Venturi tube is arranged in an orifice of a housing in a positively secured manner and in such a manner that it cannot rotate.

In order to obtain the simplest arrangement of the connector box saving the most space, it is advantageous to arrange the channels between the Venturi distributor and the evaporator pipes radially and to terminate each of them in a connector fitting, to provide the collector chamber with a plurality of connector fittings and to fasten the evaporator pipes in the connector fittings in a coolant tight manner.

An advantageous configuration of the invention resides in the connector box comprising at least two plates placed upon each other, with the channels being provided in the form of grooves in the surface of one of the two plates and covered by the other plate. In this manner, a connector box with any desired configuration of the channels can be produced very easily by the injection molding process. The connector box according to the invention makes it possible in addition to produce the individual structural parts from different materials, each adapted to specific requirements.

The Venturi distributor is preferably fastened to the plate facing away from the evaporator block, and its outlet channels open into the starting areas of the grooves.

In an advantageous further development of the invention, connector fittings for the evaporator pipes and the collector chamber are provided in a first plate, with the connector pipes and the collector chamber being covered on the side facing away from the evaporator pipes by a second plate. In this manner, the connector fittings may be produced very easily as passage bores and the collector chamber as a recess on one side of a first plate. In order that only one of the two plates need be made according to a specific configuration, while the other plate remains flat, it is advantageous to also arrange in the first plate the grooves forming the channels which lead from the Venturi distributor to the connector fittings.

There are a number of modes whereby the two plates may be joined in a coolant tight manner. Thus, for example, the plates may be soldered or adhesively bonded together on their contact faces; however, it is also possible to join together the two parts by means of screws, rivets or beading or crimping, with a seal being inserted between the plates. In order to obtain the same pressure drop in all of the channels, it is of advantage in the case of channels of equal cross section to have channels of equal length, for example, by having bends in the grooves.

If for design reasons the channels are of different lengths and it is nevertheless desired that the same pressure drop be achieved in each, it is advantageous to provide the longer channels with a larger diameter than the shorter ones. In order to eliminate interfering effects in the collector chamber which appear as a function of the layout of the compressor suction line, the differential velocity profile in the collector chamber is compensated by adapting the diameters of the channels.

To further simplify the assembly with respect to production and to reduce the weight, it is advantageous to manufacture the connector box in two parts, wherein one part is laid out as the distributor box receiving the body with the channels and the other part as the collector box.

The fastening and sealing of the Venturi distributor can be effected in different ways. For a releasable connection, it is proposed that the Venturi distributor be fastened to the connector box by means of the beading or crimping of tabs or by means of a hollow threaded bolt and sealed with an annular gasket. A simple, non-releasable fastening of the Venturi distributor in the connector box, wherein no gasket is required, consists of adhesively bonding the Venturi distributor in the connector box. For this purpose, the Venturi distributor has a circumferential configuration to accommodate the needs of adhesive bonding technology. This may consist of a plurality of grooves extending in the circumferential direction or of knurling. The cavities formed by the grooves or the knurling accept the adhesive which effects the bonding and sealing. In the simplest possible configuration of the connector box, each of the evaporator pipes is fastened to the connector box at its beginning and at its end only. For this purpose, preferably each of the evaporator pipes consists of several bifurcations interconnected by pipe bends or elbows.

In order to eliminate connection of the bifurcated pipes by means of separate pipe elbows, it is advantageous to provide reversing channels in the connector box, whereby each of the reversing channels connects together two bifurcated pipes. For manufacturing reasons, the arrangement of reversing channels in single piece connector boxes is hardly possible. It is therefore of advantage to provide a two-part connector box, comprising a cover part and a bottom part, with the parting plane extending between the connector fittings and the reversing channels. This obviously requires a large joining surface between the cover part and the bottom part. The present invention also sets forth measures to increase the rigidity and tightness of the joint of the cover part and the bottom part.

If for some reason a multiple part connector box with large joining surfaces is undesirable, it is advantageous to provide a plurality of orifices in the connector box, arranged below the channels and transversely to them, with these orifices serving to receive the fingers of an insert. The reversing channels are located on the side of the fingers facing the connector fittings, with two connector fittings opening into the orifices in the area of each reversing channel. Measures to close the orifices by suitable means for the fastening and sealing of the insert are set forth in the detailed description below.

Numerous factors must be considered in the selection of material. Thus, it must be ascertained whether the material is impermeable to the coolant, i.e., in particular, fluorinated hydrocarbons must not diffuse through it. The workability, the price and the weight of the material are also of importance. For this reason, the connector box preferably consists of a fiber-reinforced polyamide or of aluminum. To prevent the diffusion of the coolant through the material, the connector box may be clad and/or jacketed with a layer of a material impermeable to the coolant.

Exemplary embodiments of the evaporator according to the invention are explained in detail hereinafter with reference to the drawings.

FIG. 1 shows a connector box 7, consisting essentially of two plates placed over each other, i.e. a first plate 74 and a second plate 75. A bottom plate 73 is further provided, wherein the ends of the bifurcated pipes 31 and 33 are secured by means of flaring. Together with a plurality of fins 6, the bifurcated pipes 31 and 33 form an evaporator block.

In the first plate 74, several connector fittings 12, 14, 18, 19 are arranged, with the connector fittings extending over the entire thickness of the first plate 74. On the side facing the bottom plate 73, the connector fittings 12, 14, 18, 19 have counterbores 71, wherein gaskets 72 are arranged; they sealingly enclose the ends of the bifurcated pipes 31 and 33.

In the first plate 74, elongated recesses 76 are arranged on the side facing away from the evaporator block, into which one each of the connector fittings 18 and the fittings 19 open. The recesses 76 thus represent reversing channels, connecting one bifurcated pipe 31 and a bifurcated pipe 33. Grooves 80 and 81 are further coordinated with the first plate 74, on the side of the longitudinal recesses 76. A second plate 75 is fastened on the side of the first plate 74 facing away from the evaporator block, with the insertion of a gasket 77; it covers all of the orifices on this side of the plate 74. In the assembled state of the connector box 7, the recesses and grooves provided in the first plate 74 thus constitute channels. On the second plate 75, a Venturi distributor 9 is mounted, wherein the coolant flow is uniformly divided into several outlet channels 10. The outlet channels 10 open into the initial areas of the grooves 80 and 81. Therefore, a groove 80 or 81 leads in each case from the outlet channels 10 to a connector fitting 12, each of the latter receiving the beginning of an evaporator pipe, a so-called line, formed by the succesive connection of two bifurcated pipes. Each line opens into a collector chamber 13, into which the connector fitting 14 lead. A compressor suction line extending into the collector chamber 13 is designated by 15.

Figure 2:
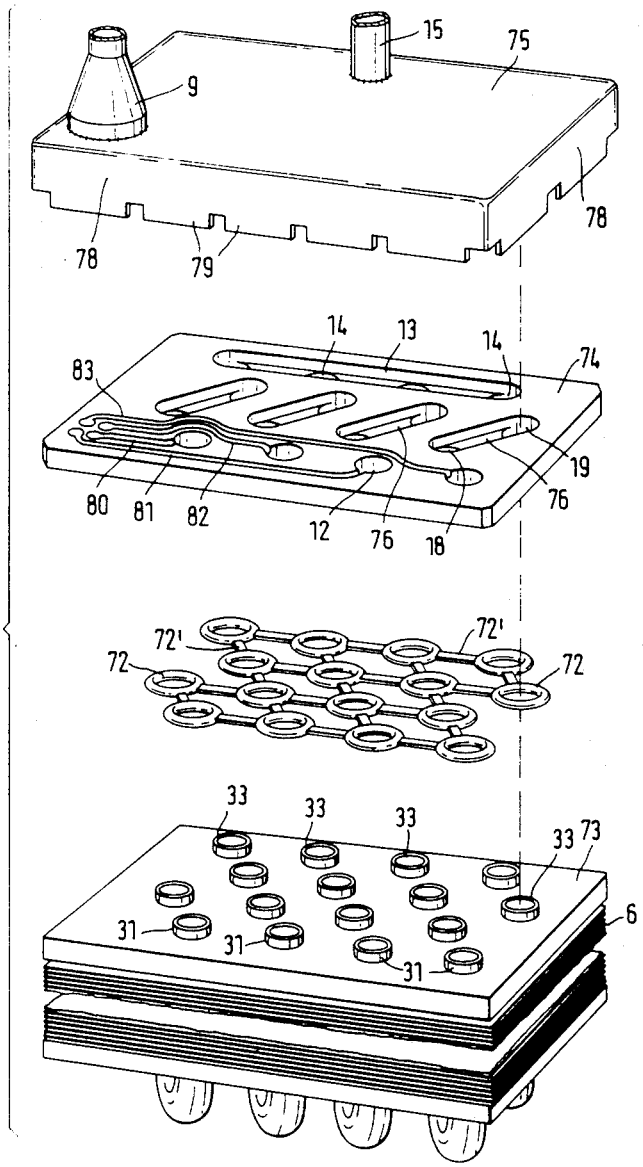
FIG. 2 is an exploded perspective view of a connector box according to FIG. 1.

FIG. 2 shows an exploded view of a connector box for an evaporator with 4 lines. Identical parts are designated by the same reference symbols. In the upper part of FIG. 2, a second plate 75 is shown; it is equipped with drawn down lateral walls, of a height so that in the assembled state they extend over both the first plate 74 and the bottom plate 73, while the projecting tabs 79 serve to establish a beaded or crimped joint. A Venturi distributor 9 and a compressor suction line 15 are mounted on the second plate 75.

The first plate 74 is shown under the second plate 75. Provided on this first plate 74 are all of the connector fittings 12, 14, 18 and 19 and the grooves 81–84 leading from the Venturi distributor to the connector fittings 12, together with the elongated recesses 76 forming the reversing channels from the connector fitting 18 to the fitting 19, and the collector chamber 13 connecting all of the connector fittings 14. The gaskets 72 are shown under the second plate. To simplify the assembly operation, they are connected by means of webs 72'. The evaporator block, consisting of several bifurcated pipes 31 and 33, and the fins 6 arranged transversely to said bifurcated pipes, can be seen in the lower part of FIG. 21. The ends of the bifurcated pipes 31 and 33 are mounted in a bottom plate and protrude past said bottom plate so that the gaskets 72 may be placed on the ends of the bifurcated pipes 31 and 33.

Figure 3:
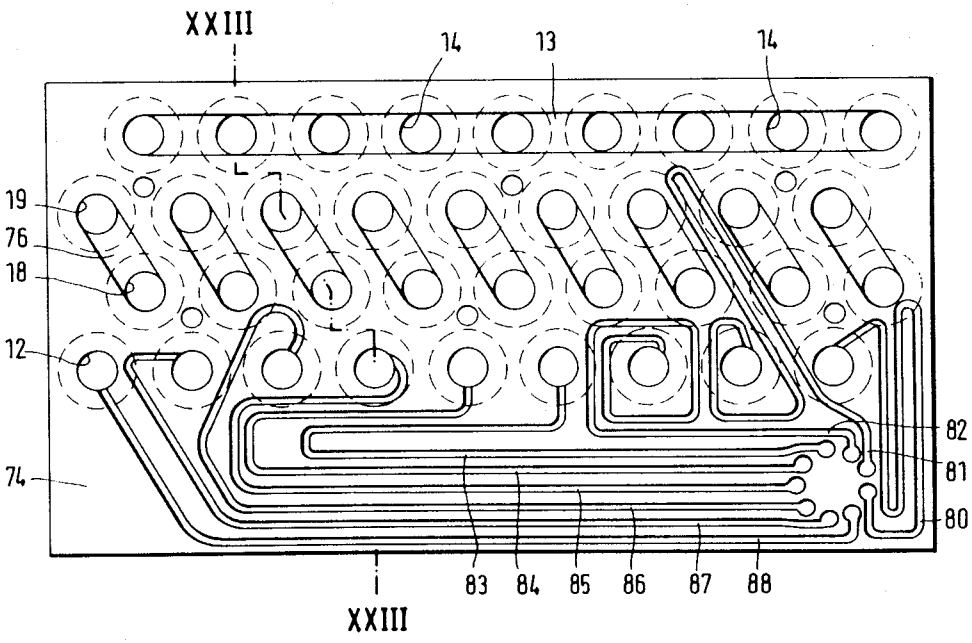
FIG. 3 is a top view of the plate carrying the grooves, connector fittings and reversing channels (for an evaporator comprising nine lines)

FIG. 3 shows a first plate 74 for an evaporator comprising nine lines. This plate contains a recess extending over all of the connector fittings 14, representing the collector chamber 13. The rows of connector fittings 19 and 18 are located adjacently, with one of the fittings 18 in each case being connected with an elongated recess 19 forming the reversing channel. Nine connector fittings 12 are arranged in the lowest row, each opening into a groove 80–88. These beginnings of the grooves are arranged on a circular line, so that the outlet channels of the Venturi distributor always open into one of the grooves 80–88. The configuration of the grooves 80–88 are chosen by means of appropriate bending pathways so that the length of each of the grooves is approximately equal.

Figure 4:
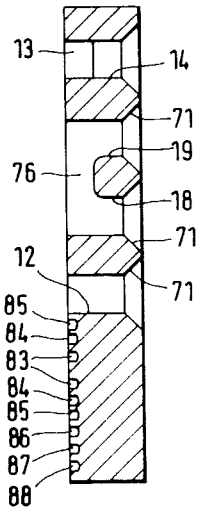
FIG. 4 is a cross-sectional view taken along the line XXIII—XXIII in FIG. 3.

In FIG. 4 a cross section along the line XXIII—XXIII in FIG. 3 is shown. As seen in FIG. 4, the connector fittings 12, 14, 18, 19 are passage bores, equipped on one side with counterbores 71. On the side of the plate facing away from the counterbores may be seen the grooves 83–88 and the recesses 76 serving as the reversing channels, together with the collector chamber 13. The grooves 80, 81 and 82 in FIG. 22 are not in the sectioning plane of FIG. 23.

What is claimed is:

1. An evaporator, comprising:

a connector member comprising at least two plates located one above the other;

a Venturi distributor connected to said connector member for receiving and distributing a coolant, wherein said Venturi distributor divides said coolant into a plurality of streams;

a plurality of channels arranged as grooves on the surface of one of said two plates and covered by the other of said two plates for conducting the coolant streams from said Venturi distributor, said channels corresponding in number to said streams with each channel being positioned to receive one of said streams from said Venturi distributor;

a plurality of evaporator pipes connected to said connector member in parallel flow arrangement, said pipes corresponding in number to said channels with each pipe being connected to one of said channels, thereby forming a continuous coolant flow path from said Venturi distributor via said channels to said evaporator pipes; and a collection chamber formed in said connector member for receiving said coolant from said pipes.

2. An evaporator according to claim 1, wherein said first plate comprises a plurality of connector fittings for connecting said evaporator pipes and said collector chamber, and wherein said connector fittings and said collector chamber are covered by said second plate on the side facing away from said evaporator pipes.

3. An evaporator according to claim 2, further comprising a plurality of reversing channels for conecting two evaporator pipes formed in said connector member between said connector fittings and a plurality of intermediate connector fittings opening into said reversing channels to receive said evaporator pipes.

4. An evaporator according to claim 3, wherein said reversing channels comprise longitudinal recesses arranged on the side of said first plate covered by said second plate.

5. An evaporator according to claim 1, wherein said Venturi distributor is fastened to one of said plates, and wherein said grooves are provided in said other plate, said grooves originating from a circular pattern of said Venturi distributor outlet channels.

6. An evaporator according to claim 1, wherein said two plates are soldered together at their contact surfaces.

7. An evaporator according to claim 1, wherein said two plates are adhesively bonded together at their contact surfaces.

8. An evaporator according to claim 1, wherein said two plates are connected by means of a mechanical fastener and wherein a gasket is inserted between the plates.

9. An evaporator according to claim 1, wherein said grooves comprise a suitably curved configuration in order to provide equal length channels leading from said Venturi distributor to connection fittings connecting said channels to said evaporator pipes.

10. An evaporator according to claim 1, further comprising a compressor suction line, said suction line opening into said collection chamber for removing said coolant from said chamber.

11. An evaporator according to claim 1, wherein said connector member comprises a metal.

12. An evaporator according to claim 11, wherein said metal comprises aluminum.

13. An evaporator according to claim 1, wherein said connector member is clad or jacketed with a layer of a material impermeable to the coolant.

14. An air conditioning system for an automotive vehicle, comprising:

a compressor;

means for driving the compressor from the engine of the automotive vehicle; and an evaporator connected to said compressor, said evaporator comprising an evaporator as defined by claim 1.

* * * * *